US005929354A

United States Patent [19]

Davis

[11] Patent Number: 5,929,354

[45] Date of Patent: Jul. 27, 1999

[54] ONE-PIECE DRUM PRACTICE PAD AND METHOD OF PRACTICING DRUMMING

[75] Inventor: Jimmy C. Davis, Scottsburg, Ind.

[73] Assignee: Ethos International Corporation, Scottsburg, Ind.

[21] Appl. No.: 08/791,263

[22] Filed: Jan. 30, 1997

[51] Int. Cl.[6] ..... G10D 13/02

[52] U.S. Cl. ..... 84/411 P

[58] Field of Search ..... 84/411 P, 411 R, 84/414

[56] References Cited

U.S. PATENT DOCUMENTS

| | | | |
|---|---|---|---|
| D. 320,035 | 9/1991 | Magruder | D17/22 |
| D. 348,476 | 7/1994 | O'Connor | D17/22 |
| 2,475,873 | 7/1949 | Banta | 84/411 R |
| 2,565,225 | 8/1951 | Gladstone | 84/411 |
| 3,186,290 | 6/1965 | Gould et al. | 84/411 R |
| 3,597,520 | 8/1971 | Andrews | 84/411 |
| 3,615,946 | 10/1971 | Palmer | 156/3 |
| 4,102,235 | 7/1978 | LeMasters | 84/411 |
| 4,106,079 | 8/1978 | Drury | 362/34 |
| 4,114,500 | 9/1978 | Norbeck | 84/385 P |
| 4,179,974 | 12/1979 | Trankle | 84/411 |
| 4,406,207 | 9/1983 | Criscione | 84/411 |
| 4,852,443 | 8/1989 | Duncan et al. | 84/1.04 |
| 5,248,715 | 9/1993 | Gray et al. | 524/265 |
| 5,520,090 | 5/1996 | Eagle | 84/411 P |
| 5,744,737 | 4/1998 | Carter | 84/411 P |

OTHER PUBLICATIONS

Thoroughbred Music, Inc. catalog (cover and p. 75), published at least as early as Jan. 17, 1997 when made of record in the file of Patent No. 5,744,737 to Carter.

Drum! Magazine, ad for "The Perfect Drum Practice Pad", JEMM, vol. 6, #3, May/Jun. 1997.

Furon Cohr$_{lastic}$, Silicone Rubber Products Catalog, Jun. 1997, 12 pp.

Gair, Thomas J., "The Spectrum of Silicone Application", Applied Polymer Symposia, No. 14, Polytechnic Institute of Brooklyn, Brooklyn, New York, Feb. 7–8, 1969.

Harper, "Handbook of Plastics and Elastomers", 1975, pp. 10–2 through 10–7 .

Salamone, "Polymeric Materials Encyclopedia", 1996, pp. 7706–7711.

*Primary Examiner*—William M. Shoop, Jr.
*Assistant Examiner*—Shih-yung Hsieh
*Attorney, Agent, or Firm*—Woodard, Emhardt, Naughton, Moriarty & McNett

[57] ABSTRACT

A one-piece, silicone rubber drum practice pad and method of practicing drumming. Silicone of the VMQ family and having a durometer of approximately 40 and tensile strength of approximately 1000 is molded into a flat pad approximately 6 inches square, 1/16 inch thick and 60 grams in weight.

18 Claims, 1 Drawing Sheet

ONE-PIECE DRUM PRACTICE PAD AND METHOD OF PRACTICING DRUMMING

BACKGROUND OF THE INVENTION

This invention relates to devices used to practice drumming and, more specifically, to practice pads.

When learning to play the drums or warming up before a performance, it is often useful to have a surface other than an actual drum on which to practice. For example, noise is unacceptable to others in many settings where a drummer would have the time and inclination to practice. Likewise, since drumsticks are readily transported but the drums themselves are not, and since drums also require open floor space for set-up, there are many situations which would be suitable for practice but where, as a practical matter, a drummer cannot have drums.

Various types of drum practice pads have been proposed in the past, as exemplified by the following patents:

| Patent No. | Inventor | Issue Date |
|---|---|---|
| 2,565,225 | Gladstone | Aug. 21, 1951 |
| 3,597,520 | Andrews | Aug. 3, 1971 |
| 4,102,235 | LeMasters | Jul. 25, 1978 |
| 4,179,974 | Trankle | Dec. 25, 1979 |
| 4,406,207 | Criscione | Sep. 27, 1983 |
| D320,035 | Magruder | Sep. 17, 1991 |
| D348,479 | O'Connor | Jul. 5, 1994 |

Some practice pads, such as in the above-referenced LeMasters and Gladstone patents, are designed for use on the playing head of a drum. There are other types of practice pads, such as those in the above-referenced O'Connor and Criscione patents, that are provided with their own means of support, such as a support stand or a mounting structure adapted to be strapped around a drummer's leg. Another type of practice pad is designed for use on a table or other suitable supporting object.

Practice pads designed for tabletop use and the like have conventionally had either a large piece of rubber, which is fairly thick, to provide sufficient resiliency and also protect the underlying surface, or multiple layers provided for different purposes. For example, in the past, a three-piece design has been utilized consisting of a rigid substrate sandwiched between two layers of gum rubber. The top layer of rubber provided a striking surface. The rigid substrate, consisting of either metal or wood, provided both support for the top and bottom layers of rubber and weight to help keep the device stationary. The bottom surface of the bottom layer of rubber was roughened to reduce sliding or lateral movement of the pad on the underlying surface, which is known to be likely to occur when a pad simply placed on a supporting surface is struck with drumsticks. With the present state of the art, the better these devices are at resisting movement in use, the heavier and more cumbersome they become. Also, additional manufacturing steps performed to increase gripping ability add to production time and costs.

Thus, there remains a need for a practice pad that meets the following requirements:

1. It must be simple and inexpensive to manufacture;
2. It must be durable;
3. It must have sufficient resiliency so as to simulate the tactile response of an actual drum while protecting the supporting surface;
4. It must not move about on the table, or other suitable means of support, when being struck;

5. It must sufficiently dampen or mute the sound so as to minimize the disturbance to others; and
6. It must be lightweight and easily transported and used.

SUMMARY OF THE INVENTION

This invention provides a one-piece silicone rubber drum practice pad that meets the above requirements while overcoming the aforementioned problems as well as other disadvantages of the prior art. Instead of multiple layers, a single, thin, lightweight layer of silicone rubber provides both a striking surface and a gripping surface. Instead of adding weight to reduce sliding, this invention uses the unique properties of the silicone to practically eliminate all lateral movement. It is believed that an electrostatic attraction develops between the silicone pad and the underlying surface that combines with suction between the two to hold the pad securely in place during use, while allowing the pad to be readily removed by hand and easily carried along with drumsticks from place to place. It is further believed that, the more the silicone pad is struck, the greater the electrostatic field that develops and the stronger the attraction between the practice pad and the supporting surface. These properties together with the pad's light weight allow it to be attached to and used on any suitable surface with an angle from 0° to 90° with respect to the horizontal.

These and other advantages of the present invention will be more apparent upon reading the following Detailed Description of the Preferred Embodiment in conjunction with the accompanying drawing.

DESCRIPTION OF THE PREFERRED EMBODIMENT

Figure 1:
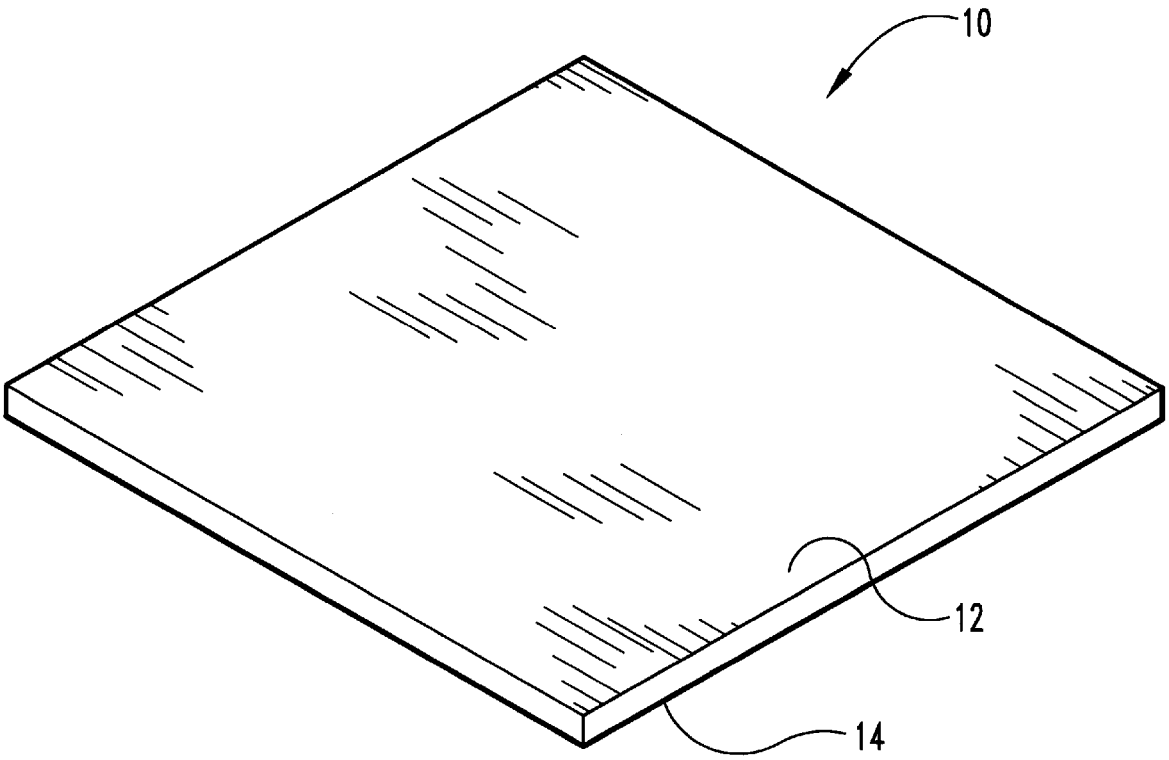
FIG. 1 is a perspective view of a practice pad constructed in accordance with this invention.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

As shown in FIG. 1, a pad 10 for practicing drumming constructed in accordance with the teachings of this invention comprises a single layer of silicone rubber with smooth, flat top and bottom surfaces 12 and 14. The silicone is preferably of the VMQ family with the following physical parameters:

| | | |
|---|---|---|
| 1. | MODULUS (@ 100% elongation) | 117–154 psi |
| 2. | TENSILE STRENGTH (ASTM D412) | 790–1015 psi |
| 3. | ELONGATION @ 100% (ASTM D412) | 424–559 |
| 4. | DUROMETER (Shore A) (ASTM D2240) | 30–80 |
| 5. | PLASTICITY | 0 |
| 6. | SPECIFIC GRAVITY (ASTM D792) | 1.10–1.18 |

Material meeting these specifications is available from Freudenberg—NOK, Scottsburg, Ind., as compound LZ414.

Most preferably, the material has a durometer of 40, a tensile strength at the high end of the above range, and a specific gravity of 1.14. The thickness of the pad may be less than ¼ inch, and is preferably in the range of of 0.05 inches to 0.07 inches, and most preferably 1/16 inch. While FIG. 1 depicts the above embodiment as a square sheet, its shape is not critical to its functionality. The corners of the pad are conveniently rounded, and the pad may be molded in a variety of convenient shapes. Black silicone is presently preferred, although other colors are contemplated as well as clear silicone and silicone that is phosphorescent, fluorescent or otherwise luminescent. In order to optimize the pad's portability in combination with its utility for its intended purpose, its size should be between 3 and 6 inches across the striking and gripping surfaces. Most preferably, for a square pad, the pad is between 5¾ and 6 inches square, and approximately 60 grams in weight. Such a pad is so flexible that it can be wrapped around a drumstick or pair of drumsticks and held in place with a rubber band or the like for transport virtually as easily as the drumsticks themselves can be transported.

In use, the practice pad is placed on a flat support surface that is preferably also sold, smooth, clean and dry, and it is locked in place by simply pressing firmly and twisting with the palm of the hand. Practicing on the pad with drumsticks tightens the grip on the underlying surface, which, it will be noted, may be level but may alternatively be a vertical surface, e.g., a door, wall or cabinet.

The practice pad is easily cleaned by rubbing it while rinsing to remove dirt and grime and then towel drying thoroughly to restore its stickiness.

The practice pad as disclosed herein provides distinct advantages over all known prior art devices, and, generally, provides a superior combination of desirable attributes for a drum practice pad, including realistic tactile response, positional stability, sound-muting ability, protection of the supporting object, durability, light weight, ease of transport and use, simple design, and inexpensive manufacture.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

I claim:

1. A one-piece drum practice pad removably adhered to a flat support surface for practicing drumming, said drum practice pad comprising a single, thin layer of silicone rubber less than 12 inches in maximum cross-section, and having a smooth, flat surface removably adhered to said support surface and resistant to lateral movement of said pad along said support surface, said silicone rubber layer having sufficient resiliency to simulate the tactile response of a real drum while protecting the support surface when said pad is struck with a drumstick.

2. The one-piece drum practice pad of claim 1, wherein said silicone rubber is in the VMQ family of silicone and has a durometer of 30–50 on the Shore A scale.

3. The one-piece drum practice pad of claim 2, wherein said layer of silicone rubber is clear.

4. The one-piece drum practice pad of claim 2, wherein said layer of silicone rubber is luminescent.

5. A one-piece drum practice pad, comprising a single layer of silicone rubber less than 12 inches in maximum cross-section and of thickness and resiliency to simulate the tactile response of a real drum when said pad is placed on a flat support surface and struck by a drumstick, said silicone rubber resisting lateral movement of said pad on said support surface when said pad is struck by the drumstick.

6. The one-piece drum practice pad of claim 5, further comprising a smooth, flat surface on said pad for adhering to the support surface.

7. The one-piece drum practice pad of claim 5, wherein said layer of silicone rubber is generally square in shape and approximately 6 inches by 6 inches in size.

8. The one-piece drum practice pad of claim 5, wherein said silicone rubber is in the VMQ family of silicone and has a durometer of 40–50 on the Shore A scale.

9. The one-piece drum practice pad of claim 5, wherein said silicone rubber has a tensile strength in the range of 790–1015 psi.

10. The one-piece drum practice pad of claim 5, wherein said layer of silicone rubber is clear.

11. The one-piece drum practice pad of claim 5, wherein said layer of silicone rubber is luminescent.

12. A method of practicing drumming with realistic tactile response and positional stability without a real drum, and without damage to physical objects exposed to striking forces from drumsticks during a practice session, comprising the steps of:

providing a supporting object having a flat surface;

placing a thin, one-piece, silicone rubber pad on said flat surface of said supporting object; and striking the pad with drumsticks to practice drumming.

13. The method of claim 12, wherein said silicone rubber pad is fabricated from VMQ silicone with a durometer of 30–50 on the Shore A scale.

14. The method of claim 13, wherein said silicone rubber pad has a tensile strength in the range of 790–1015 psi.

15. The method of claim 14, wherein said silicone rubber pad is made to have a smooth, flat surface for adhering to the flat surface of said supporting object.

16. The method of claim 15, wherein said layer of silicone rubber is made generally square in shape and approximately 6 inches by 6 inches in size.

17. The method of claim 16, wherein said flat surface is a vertical surface, and wherein said method further includes the step of adhering said pad to said vertical surface of said supporting object.

18. A method of practicing drumming with realistic tactile response and positional stability without a real drum, and without damage to physical objects exposed to striking forces from drumsticks during a practice session, comprising the steps of:

providing a supporting object having a flat support surface angled anywhere from 0° to 90° with respect to horizontal;

placing on said support surface a one-piece, silicone rubber pad fabricated from VMQ silicone with a durometer of approximately 40 on the Shore A scale and having a pair of parallel, smooth, flat surfaces; and striking the pad with drumsticks to practice drumming.

* * * * *